US007794258B2

(12) United States Patent
Tu et al.

(10) Patent No.: US 7,794,258 B2
(45) Date of Patent: Sep. 14, 2010

(54) CARD SOCKET ASSEMBLY

(75) Inventors: Ying-Liang Tu, Shenzhen (CN); Jun-Jie Deng, Shenzhen (CN)

(73) Assignees: Shenzhen Futaihong Precision Industry Co., Ltd., ShenZhen, Guangdong Province (CN); FIH (Hong Kong) Limited, Kowloon (HK)

( * ) Notice: Subject to any disclaimer, the term of this patent is extended or adjusted under 35 U.S.C. 154(b) by 0 days.

(21) Appl. No.: 12/506,351

(22) Filed: Jul. 21, 2009

(65) Prior Publication Data

US 2010/0093203 A1 Apr. 15, 2010

(30) Foreign Application Priority Data

Oct. 13, 2008 (CN) ..... 2008 1 0304895

(51) Int. Cl.
*H01R 13/62* (2006.01)

(52) U.S. Cl. ..... 439/326

(58) Field of Classification Search ..... 439/326, 439/660, 630
See application file for complete search history.

(56) References Cited

U.S. PATENT DOCUMENTS 6,561,431 B2 * 5/2003 Roussy et al. ..... 235/492
7,390,204 B2 * 6/2008 Tanaka et al. ..... 439/159

* cited by examiner

*Primary Examiner*—Phuong K Dinh
(74) *Attorney, Agent, or Firm*—Steven M. Reiss

(57) ABSTRACT

A card socket assembly includes a base, two latching mechanisms, and an elastic member. The base includes a mounting surface. The two latching mechanisms are oppositely fastened to the mounting surface. The two latching mechanisms and the mounting surface cooperatively enclose a card slot, used to receive a data card therein. The elastic member is disposed adjacent to the card slot and exposed within the card slot. The elastic member elastically biases the data card against the latching mechanisms.

13 Claims, 3 Drawing Sheets

CARD SOCKET ASSEMBLY

BACKGROUND

1. Technical Field

The present disclosure relates to card socket assemblies and, particularly, to a card socket assembly used in a portable electronic device, e.g., mobile phone, personal digital assistant (PDA), palm computer and etc.

2. Description of Related Art

A typical card socket assembly includes a card slot defined in a housing of a portable electronic device. The card socket assembly further includes a securing means used to secure a data card within the card slot.

However, to remove the data card from the card slot, a user has to apply a large force on the data card against a securing force of the securing means. Thus, it's easy to break the data card and the securing means, and inconvenient for use.

Therefore, there is room for improvement within the art.

BRIEF DESCRIPTION OF THE DRAWINGS

Many aspects of the card socket assembly can be better understood with reference to the following drawings. These drawings are not necessarily drawn to scale, the emphasis instead being placed upon clearly illustrating the principles of the present card socket assembly. Moreover, in the drawings like reference numerals designate corresponding sections throughout the several views.

DETAILED DESCRIPTION

Figure 1:
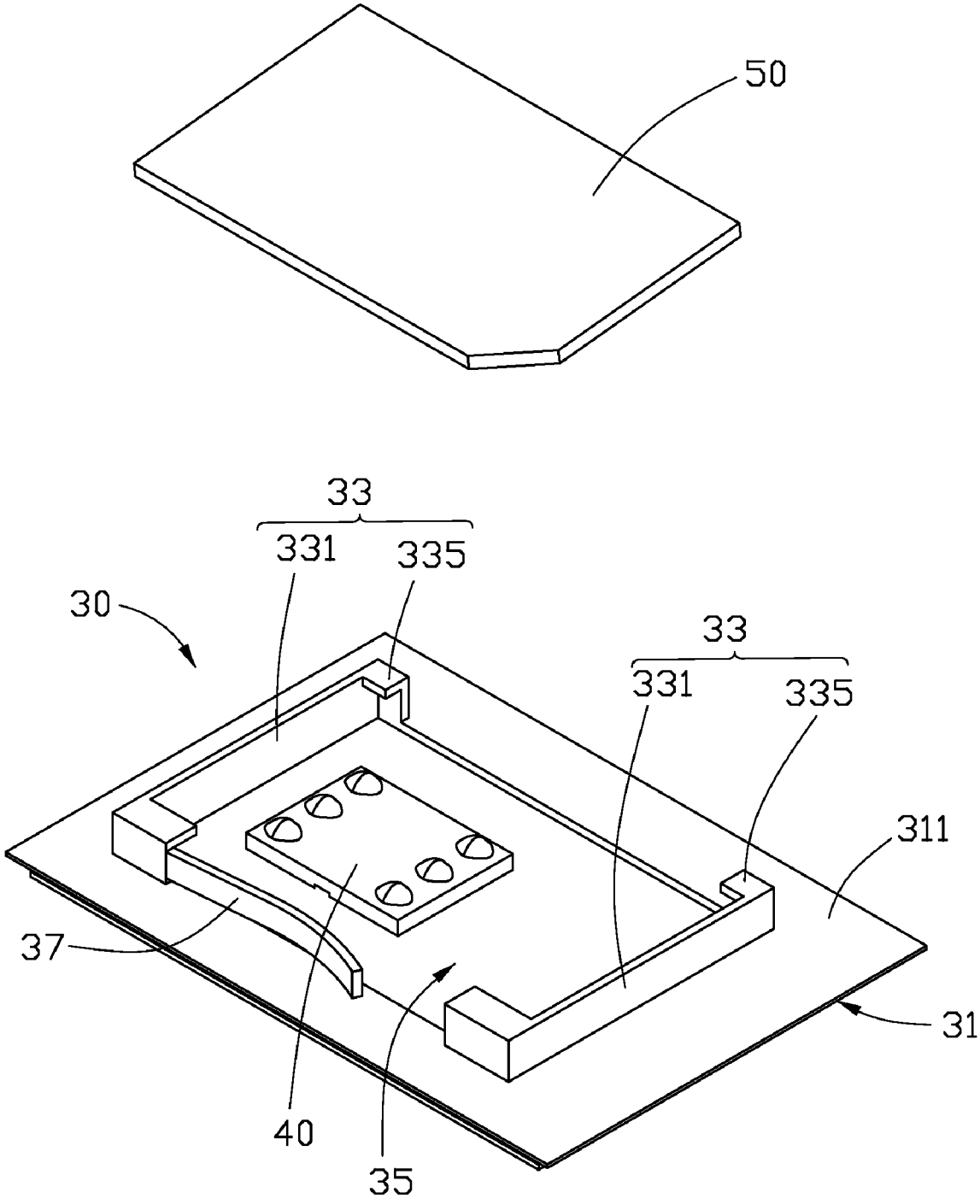
FIG. 1 is an exploded, isometric view of a card socket assembly, in accordance with an exemplary embodiment.
Figure 2:
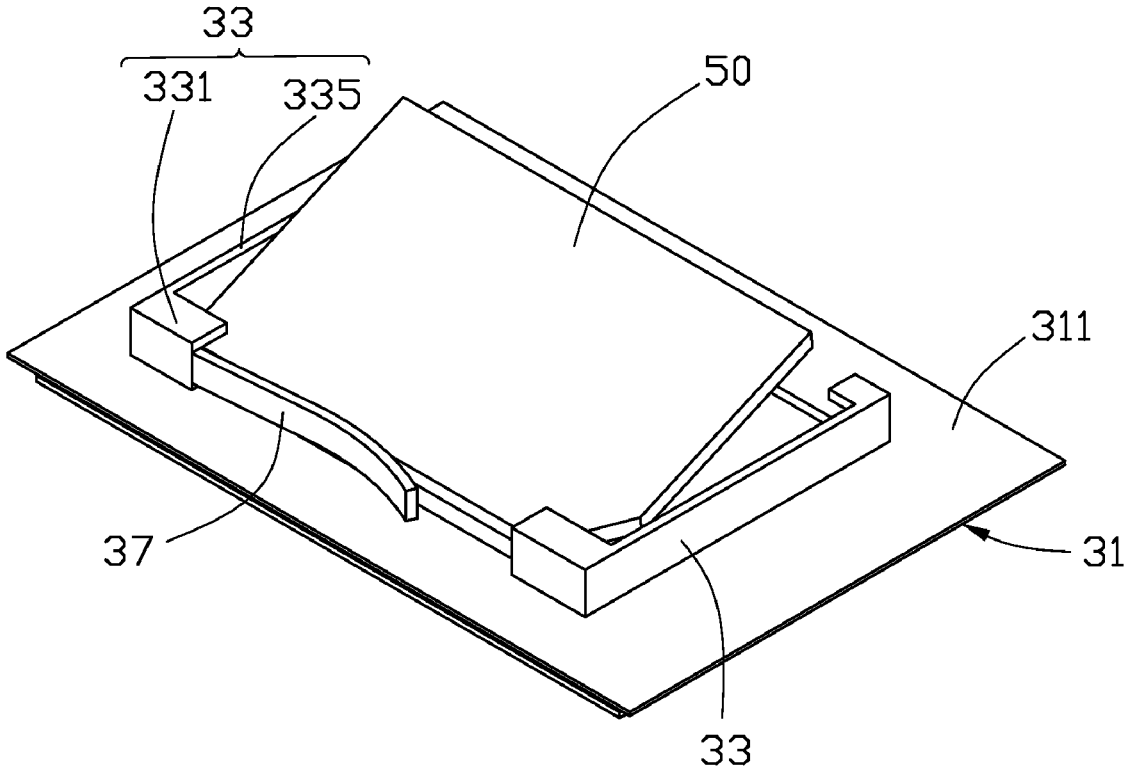
FIG. 2 is a schematic view of the card socket assembly showing the first position of a data card during assembly.

FIGS. 1 and 2 show an exemplary card socket assembly 30 used in portable electronic devices, such as mobile phone terminals, digital cameras, and others. The card socket assembly 30 includes a base 31, two latching mechanisms 33, and an elastic member 37.

The base 31 can be a portion of a housing of a mobile phone. The base 31 includes a mounting surface 311.

The two latching mechanisms 33 are oppositely fastened to the mounting surface 311. The two latching mechanisms 33 and the mounting surface 311 cooperatively enclose a card slot 35, used to receive a data card 50 therein. In this embodiment, each latching mechanism 33 includes a main wall 331 perpendicularly extending from the mounting surface 311 and two limiting blocks 335. The main walls 331 are generally U-shaped, and oppositely fastened to the mounting surface 311. The two limiting blocks 335 protrude from opposite ends of the main wall 331 toward the card slot 35 and away from the mounting surface 311. The distance between the limiting blocks 335 and the mounting surface 311 is generally as long as the data card 50. The mounting surface 311 includes a connector 40 disposed thereon and exposed within the card slot 35. The connector 40 is used to electrically contact with the data card 50.

The elastic member 37 protrudes from one end of the main wall 331 towards the card slot 35, and is partially exposed in the card slot 35. The elastic member 37 is used to securely latch the data card 50 within the card slot 35. In this embodiment, the elastic member 37 is an arced sheet spring.

Figure 3:
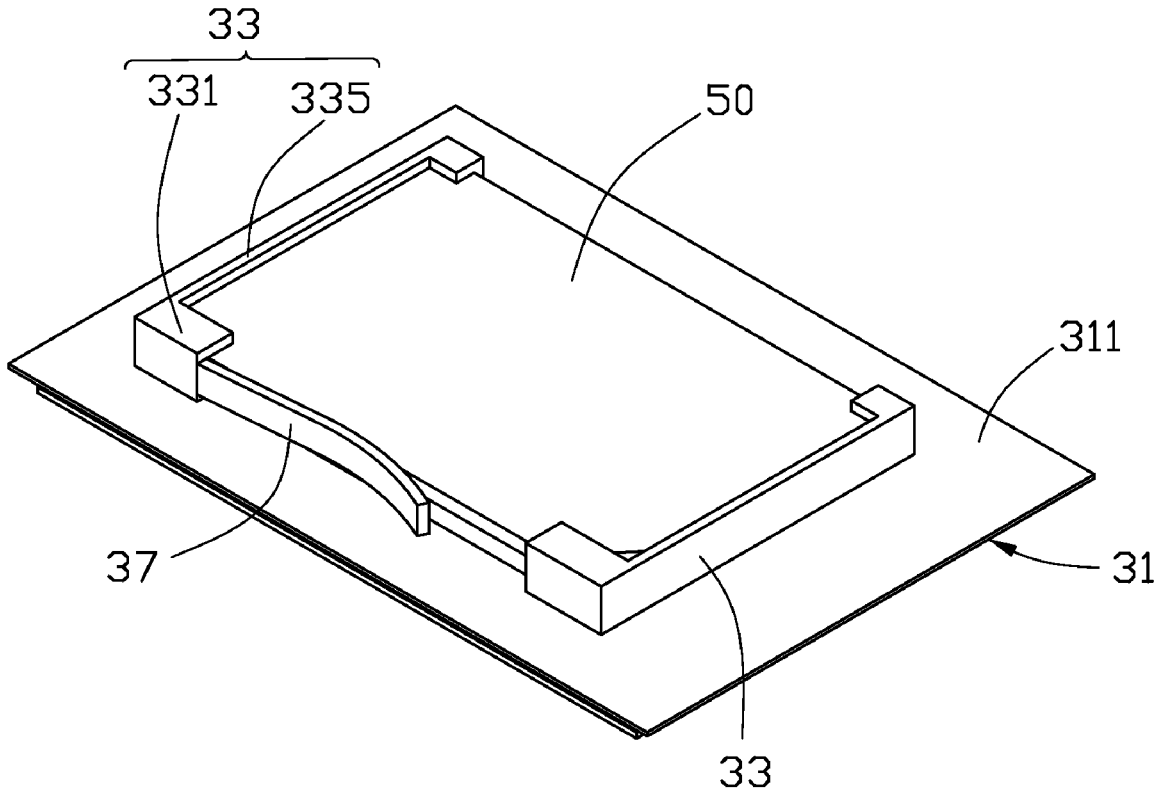
FIG. 3 is similar to FIG. 2, but showing the second position of the data card during assembly.

Referring to FIGS. 2 and 3 together, to mount the data card 50 within the card slot 35, the data card 50 is partially inserted into the card slot 50, with one side thereof abutting against the elastic member 37 and disposed under two of the limiting blocks 331. Then the data card 50 continues compressing the elastic member 37 with an external force on the data card 50 until another opposite side thereof moves beyond the other two limiting blocks 331 and into the card slot 35. At this time, the external force on the data card 50 is released, and the data card 50 is securely clamped between the elastic member 37 and the two latching mechanisms 33, and received within the card slot 35.

To release the data card 50 out of the card slot 35, the data card 50 is pushed towards and against the elastic member 37 until one side of the data card 50 opposite to the elastic member 37 moves beyond the corresponding two limiting blocks 335, thus the data card 50 can be rejected/removed from the card slot 35.

In other alternative embodiment, the latching mechanism 33 and the base 31 can be made as a whole by typical manufacture method, e.g., insert-molding.

In other alternative embodiment, the latching mechanism 33 can be other shaped, e.g., L-shaped.

In other alternative embodiment, the elastic member 37 can be disposed on the mounting surface 311 and exposed in the card slot 35.

The card socket assembly 30 is simple in configuration, and users can easily secure the data card 50 within the card slot 35 and remove the data card 50 out of the card slot 35 using the elastic member 37.

It is to be understood, however, that even through numerous characteristics and advantages of the present disclosure have been set forth in the foregoing description, together with details of the structure and function of the disclosure, the disclosure is illustrative only, and changes may be made in detail, especially in matters of shape, size, and arrangement of sections within the principles of the disclosure to the full extent indicated by the broad general meaning of the terms, in which the appended claims are expressed.

What is claimed is:

1. A card socket assembly comprising:

a base including a mounting surface;

two latching mechanisms, the two latching mechanisms oppositely fastened to the mounting surface, the two latching mechanisms spaced apart from each other, the two latching mechanisms and the mounting surface cooperatively enclosing a card slot, the card slot receiving a data card therein, and an elastic member disposed adjacent to the card slot and exposed within the card slot, the elastic member secured at one end portion of one of the two latching mechanisms, extending towards the other latching mechanism, and partially closing the card slot; the elastic member configured for elastically and horizontally biasing the data card in the card slot, an upward disengagement of the data card from the card slot being only prevented by resisting of the two latching mechanisms against the data card, and a horizontal motion followed by vertical motion for disengagement of the data card from the card slot being only prevented by the horizontal biasing of the elastic member.

2. The card socket assembly as claimed in claim 1, wherein the elastic member is disposed on the mounting surface.

3. The card socket assembly as claimed in claim 1, wherein the elastic member is a curved spring.

4. The card socket assembly as claimed in claim 1, wherein each latching mechanism includes a main wall, the main walls are a generally "U"-shaped, and oppositely fastened to the mounting surface.

5. The card socket assembly as claimed in claim 4, wherein each main wall includes two limiting blocks protruding therefrom towards the card slot and away from the mounting surface, the limiting blocks are used to keep the data card in the card slot.

6. The card socket assembly as claimed in claim 5, wherein the two limiting blocks are located at both opposite ends of the main wall, the distance between the limiting blocks and the mounting surface is generally as big as a thickness of the data card.

7. The card socket assembly as claimed in claim 1, wherein the mounting surface includes a connector disposed thereon and exposed within the card slot, the connector is used to electrically contact with the data card.

8. The card socket assembly as claimed in claim 1, wherein the latching mechanism is L-shaped.

9. The card socket assembly as claimed in claim 1, wherein the base is a housing of a portable electronic device.

10. A card socket assembly comprising:

a base;

two latching mechanisms, the two latching mechanisms oppositely fastened to the base, the two latching mechanisms spaced apart from each other, the two latching mechanisms and the base cooperatively enclosing a card slot, the card slot receiving a data card therein, and an elastic member disposed on the base and exposed within the card slot, the elastic member secured at one end portion of one of the two latching mechanisms, extending towards the other latching mechanism, and partially closing the card slot; the elastic member configured for elastically and horizontally biasing the data card in the card slot, an upward disengagement of the data card from the card slot being only prevented by resisting of the two latching mechanisms against the data card, and a horizontal motion followed by vertical motion for disengagement of the data card from the card slot being only prevented by the horizontal biasing of the elastic member.

11. The card socket assembly as claimed in claim 10, wherein the elastic member is disposed on the base.

12. The card socket assembly as claimed in claim 10, wherein the elastic member is a curved spring.

13. The card socket assembly as claimed in claim 10, wherein each latching mechanism includes a main wall, the main walls are a generally "U"-shaped, and oppositely fastened to the base.

* * * * *